United States Patent [19]

Salcone, II

[11] Patent Number: 4,674,303

[45] Date of Patent: Jun. 23, 1987

[54] SAFETY LOCK FOR SEAT BELT BUCKLE

[75] Inventor: Paul J. Salcone, II, Bristol, R.I.

[73] Assignee: P. J. Salcone's Inc., Bristol, R.I.

[21] Appl. No.: 865,797

[22] Filed: May 19, 1986

[51] Int. Cl.[4] ..... A44B 11/26; B65D 55/14

[52] U.S. Cl. ..... 70/63; 24/633; 70/162; 70/169; 70/422; 206/807; 220/210; 292/DIG. 38

[58] Field of Search ..... 70/63, 422, 1.5, 159, 70/18, 160–162, 613, 167–169; 292/DIG. 38; 24/573, 633; 220/210; 206/1.5, 807

[56] References Cited

U.S. PATENT DOCUMENTS

| | | | |
|---|---|---|---|
| 1,291,993 | 1/1919 | Matthews | 70/55 |
| 1,444,161 | 2/1923 | Arnold | 70/18 |
| 2,000,280 | 5/1935 | Fitzgerald | 70/1.5 |
| 3,484,908 | 12/1969 | Lamb | 24/574 |
| 4,220,024 | 9/1980 | Berich | 70/422 X |
| 4,322,958 | 4/1982 | Eigemeier | 292/DIG. 38 X |
| 4,454,736 | 6/1984 | Mochida | 70/422 |
| 4,462,317 | 7/1984 | Franko et al. | 70/63 X |
| 4,497,094 | 2/1985 | Morris | 70/55 X |
| 4,577,477 | 3/1986 | Olshausen | 70/63 X |
| 4,593,541 | 6/1986 | Hollis | 70/161 X |

FOREIGN PATENT DOCUMENTS

| | | | |
|---|---|---|---|
| 587940 | 11/1933 | Fed. Rep. of Germany | 70/1.5 |
| 2556352 | 6/1977 | Fed. Rep. of Germany | 70/18 |
| 2822132 | 11/1979 | Fed. Rep. of Germany | 70/422 |
| 8401275 | 4/1984 | Int'l Pat. Instutute . | |

*Primary Examiner*—Robert L. Wolfe
*Assistant Examiner*—Lloyd A. Gall
*Attorney, Agent, or Firm*—Salter & Michaelson

[57] ABSTRACT

A safety lock for a seat belt buckle includes a housing for receiving and containing the seat belt buckle therein and a locking portion for releasably retaining the housing in a closed position wherein the buckle is substantially enclosed therein. When the safety lock is assembled in the closed position on a seat belt buckle and the buckle is utilized for detachably interconnecting first and second seat belt sections, the safety lock restricts access to the buckle in a manner which normally prevents a small child from disconnecting the seat belt sections but nevertheless permits the seat belt sections to be easily disconnected by an adult.

8 Claims, 6 Drawing Figures

SAFETY LOCK FOR SEAT BELT BUCKLE

BACKGROUND AND SUMMARY OF THE INVENTION

The instant invention relates to seat belts and more particularly to a safety lock for a vehicle seat belt which can be utilized for preventing a small child from removing his or her seat belt while riding in a vehicle.

Statistical evidence has clearly proven the merits of wearing seat belts while riding in automobiles. Specifically, it has clearly been shown that the chances of a person sustaining serious physical injury when involved in an automobile accident are significantly reduced when the person is wearing his or her seat belt. In fact, for this reason many jurisdictions have adopted mandatory seat belt laws which require the use of seat belts by all persons riding in motor vehicles.

One of the problems which has frequently been encountered in connection with the use of seat belts is that it is often difficult to prevent young children from removing their seat belts while they are riding in vehicles. This problem is particularly significant with respect to young children who are riding in the back seats of vehicles where it may not be readily apparent to the other passengers of the vehicles that the children have removed their seat belts.

The instant invention relates to an effective device for preventing young children from removing their seat belts while they are riding in vehicles. Specifically, the instant invention provides a safety lock which is operable for preventing a small child from opening a seat belt buckle of the type utilized for detachably interconnecting first and second seat belt sections, wherein the buckle includes a body portion and a release button on the body portion which is operative for disconnecting the seat belt sections. More specifically, the safety lock of the instant invention comprises a housing having hingeably connected first and second housing sections which are securable in a closed position wherein they cooperate to define an open interior cavity for receiving and containing a seat belt buckle therein and wherein the housing sections further cooperate to define first and second openings at opposite ends of the housing for passing first and second seat belt sections outwardly therethrough, respectively, when the seat belt buckle is received in the housing. The openings are dimensioned to prevent the passage of the seat belt buckle outwardly therethrough while nevertheless permitting at least one of the seat belt sections to be removed from the housing when the seat belt sections are disconnected. The safety lock further includes a means for releasably retaining the housing in a closed position which preferably comprises a locking portion mounted in one of the housing sections and a removable key which is operable for moving the locking portion between a locked position wherein it secures the first and second housing sections in a closed position and an unlocked position wherein the housing sections are hingeably separable. The locking portion preferably includes a rotatable barrel portion having a peripheral collar thereon, and it is preferably received in a mounting hole in one of the housing sections so that the collar normally prevents the locking portion from being moved inwardly into the housing. The locking portion is, however, preferably constructed so that it is frangible by depressing it inwardly, and hence it can be moved inwardly into the housing to release the two housing sections to an open position.

The housing is preferably further formed with an aperture therein which is substantially aligned with the release button on the buckle when the buckle is received in the housing and the housing is in the closed position. The aperture is preferably dimensioned to prevent access to the release button with a finger of an operator but to permit access to the release button with an instrument of smaller dimension than the finger. Specifically, the aperture preferably has a width of less than approximately one quarter of an inch so that access to the release button with a finger is prevented but so that access to the release button can be obtained with an instrument of smaller dimension, such as the key for the releasable retaining means. Further, the housing is preferably constructed so that it has a pair of the apertures therein, one which is substantially aligned with the release button on a buckle when the buckle is in a normal first position in the housing and another which is substantially aligned with the release button on the buckle when the buckle is in an inverted second position in the housing.

Accordingly, for use and operation of the safety lock of the instant invention, it is secured in the closed position thereof on the buckle of a seat belt assembly so that the first and second seat belt sections connected to the buckle pass outwardly through the openings in the ends of the housing. When the safety lock is assembled in this manner, a key or a similar instrument is normally required to operate the locking portion in order to open the housing sections to a position wherein the release button is accessible. Alternatively, access to the release button can also be obtained by passing an instrument through one of the apertures in the housing, although since the apertures are dimensioned to prevent access to the release button with a finger, a child is normally prevented from gaining access to the release button to disconnect the seat belt sections. Hence, when the seat belt is worn by a young child, the chances that the seat belt will be removed by the child are substantially reduced. However, in the event of an emergency, the locking portion of the releasable retaining means can be depressed inwardly into the housing to enable the housing to be moved to an open position without the use of a key in the locking portion and without passing an instrument through one of the apertures so that an adult can quickly open the safety lock.

Accordingly, it is a primary object of the instant invention to provide a device for preventing small children from removing their seat belts while riding in automobiles.

Another object of the instant invention is to provide a safety lock comprising a housing for receiving a buckle of a seat belt therein so that access to the buckle by a small child is prevented.

A still further object of the instant invention is to provide a simple locking device for a seat belt buckle which can easily be operated by an adult but not by a small child.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
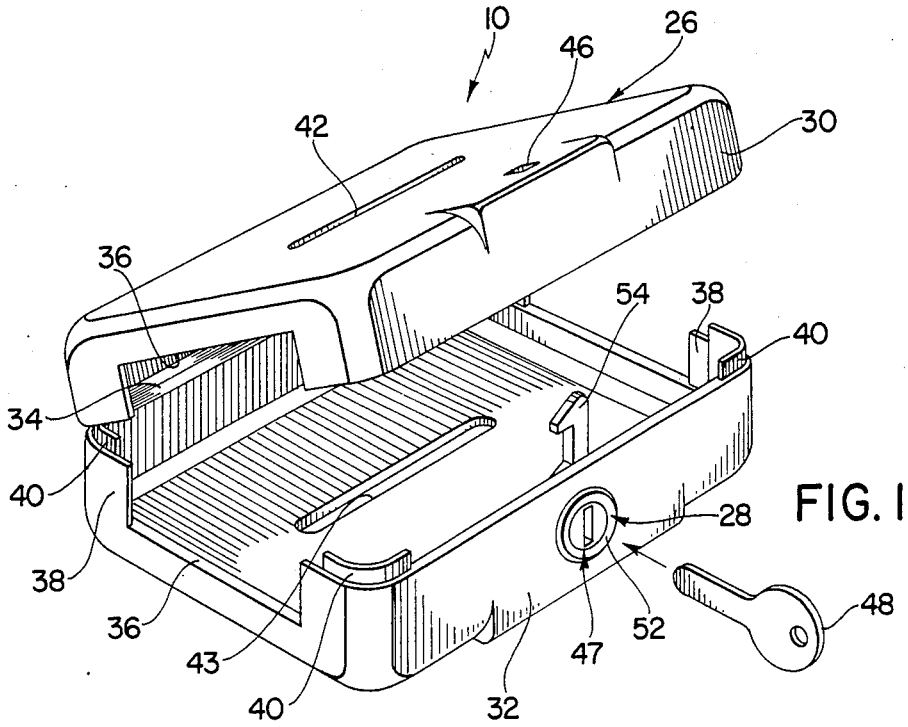
FIG. 1 is a perspective view of the locking device of the instant invention in an open position.
Figure 2:
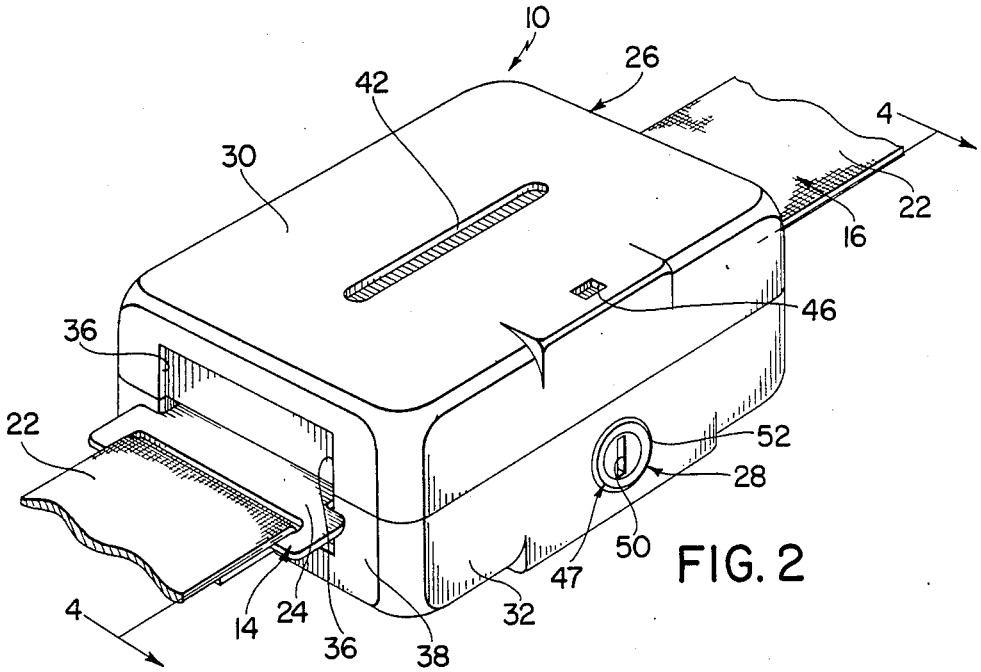
FIG. 2 is a perspective view thereof in a closed position wherein it is assembled with a seat belt buckle.

Referring now to the drawings, the safety lock of the instant invention is illustrated and generally indicated at 10 in FIGS. 1 through 5. The safety lock 10 is operable in combination with a seat belt buckle 12 of the type illustrated in FIG. 3 for preventing a small child from opening the buckle 12 to disconnect first and second belt sections 14 and 16, respectively, which are interconnected by the buckle 12. More specifically, when the buckle 12, which includes a body portion 18 and a release button 20, is assembled in the safety lock 10, the safety lock 10 provides only limited access to the release button 20 so that when the buckle 12 and the belt sections 14 and 16 are utilized for restraining a small child in a vehicle, the child is normally prevented from depressing the release button 20 to disconnect the belt sections 14 and 16.

Figure 3:
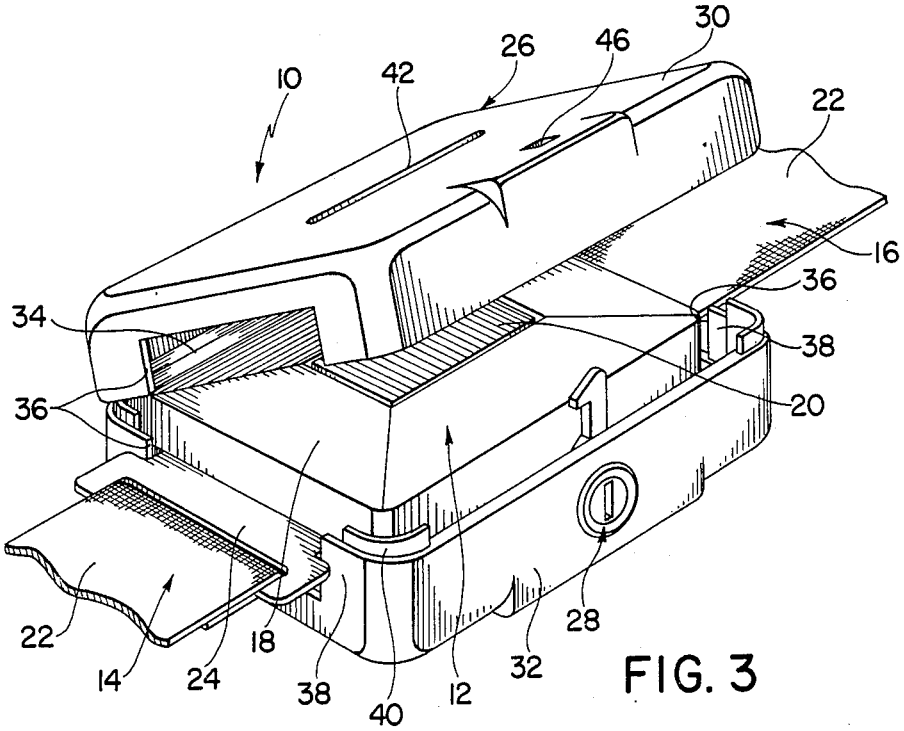
FIG. 3 is a perspective view of the locking device in an open position with a seat belt buckle received therein.
Figure 5:
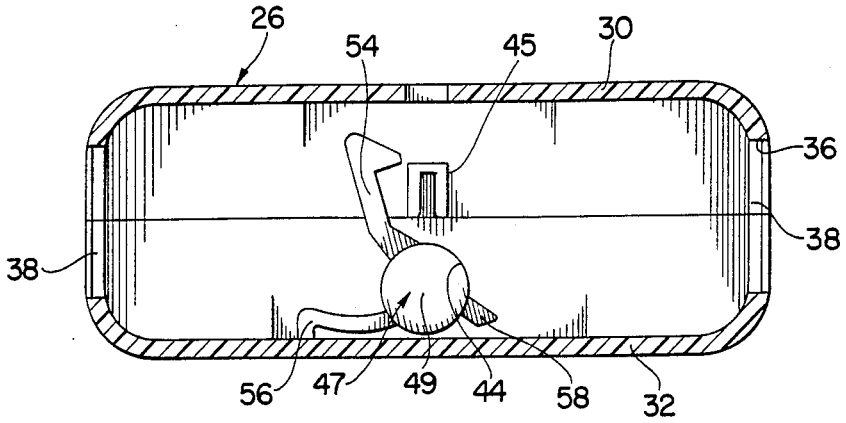
FIG. 5 is a similar sectional view with the locking portion of the lock in an unlocked position.
Figure 4:
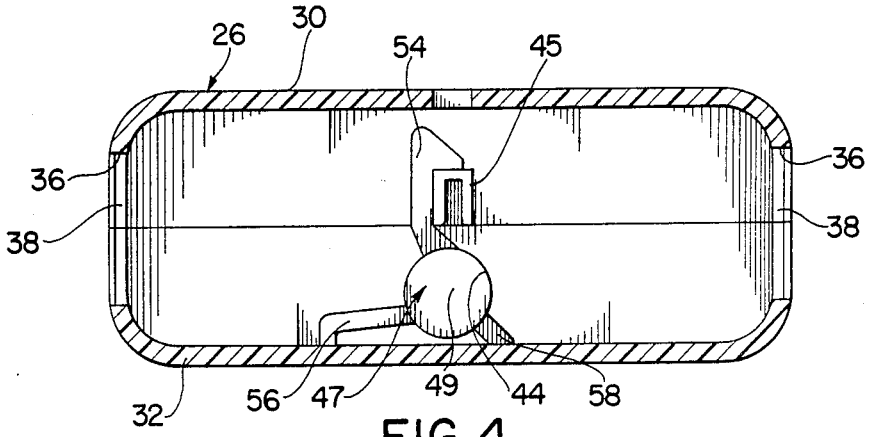
FIG. 4 is an sectional view taken along line 4—4 in FIG. 2.
Figure 6:
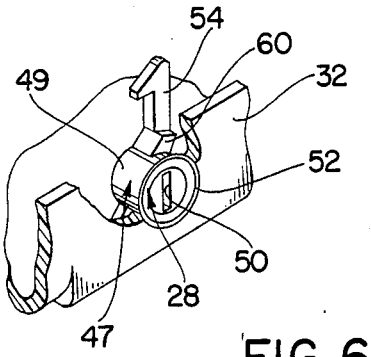
FIG. 6 is a fragmentary perspective view illustrating the locking portion of the lock.

The buckle 12 preferably comprises a seat belt buckle of conventional construction, wherein the body 18 is of substantially rectangular configuration, and the release button 20 is disposed in a central location on one side of the body 18 as illustrated in FIG. 3. The buckle 12 is constructed so that it is operable for detachably interconnecting the first and second seat belt sections 14 and 16 in a manner wherein they can easily be disconnected by depressing the button 20. The seat belt section 14 preferably comprises a strap 22 having a metallic tongue 24 thereon which is receivable in engagement in the buckle 12 for retaining the seat belt section 14 in interconnected relation therewith, and the seat belt section 16 preferably comprises a strap 22 which is secured to the buckle 12 so that it is not easily disconnectable therefrom. Accordingly, when the straps 22 are secured in a vehicle adjacent opposite sides of a seat therein, the buckle 12 can be utilized for effectively detachably interconnecting the seat belt sections 14 and 16 in order to restrain a person seated on the seat. However, by depressing the button 20, the seat belt sections 14 and 16 can normally be easily disconnected to enable the person to depart from the vehicle. It will be understood, however, that while the buckle 12 as herein embodied is adapted for use in combination with the belt sections 14 and 16, the use of the safety lock 10 with other types of seat belt assemblies which include buckles having body portions and depressible release buttons is contemplated.

The safety lock 10 comprises a housing generally indicated at 26 and a locking portion generally indicated at 28. The housing 26 comprises first and second housing sections 30 and 32, respectively, which are hingeably connected along a hinge line 34. The housing 26 is preferably integrally molded from a suitable durable plastic material so that the hinge line 34 defines a living hinge, and it is preferably constructed so that the housing sections 30 and 32 are positionable in a closed position wherein they cooperate to define an open interior cavity for receiving the buckle 12 therein. More specifically, the housing sections 30 and 32 are preferably formed as substantially rectangular open shells which are hingeably connected along the hinge line 34 so that they are positionable in a closed position wherein they define a substantially rectangular open interior cavity which is dimensioned to receive and retain the buckle 12 therein. Formed at the opposite ends of the housing sections 30 and 32 are cutouts 36 which cooperate to define openings at the opposite ends of the housing 26 when the housing sections 30 and 32 are in the closed position. Specifically, the openings defined by the cutouts 36 are dimensioned for receiving the seat belt sections 14 and 16 therethrough, and they are positioned so that when the buckle 12 is received in the housing 26 and the seat belt sections 14 and 16 are connected thereto, the belt sections 14 and 16 pass outwardly through the openings. Further, the housing sections 30 and 32 are preferably constructed so that they include removable portions 38 of reduced thickness adjacent the opposite side edges of the cutouts 36 to enable the cutouts 36 to be easily enlarged utilizing a pocket knife or the like in order to adapt the housing 26 to accommodate seat belt sections 14 and 16 of greater widths. The second housing section 32 includes corner reinforcements 40 which extend along the inner portions of the corners thereof so that they are receivable in the adjacent portions of the housing section 30 for maintaining the housing sections 30 and 32 in aligned relation when they are in the closed position. Also formed in the housing sections 30 and 32 along the main walls thereof are elongated slots 42 and 43, respectively. The slot 42 is oriented in the housing section 30 so that when the buckle 12 is received in the housing 26 and the housing sections 30 and 32 are in the closed position, the slot 42 is substantially aligned with the button 20 so that the button 20 can be depressed by inserting an instrument through the slot 42. The slot 43 in the second housing section 32 is oriented in a similar position so that when the buckle 12 is in an inverted position in the housing 26, the release button 20 can be depressed by inserting an instrument through the slot 43. In any event, both of the slots 42 and 43 are preferably dimensioned so that they prevent access to the button 20 with a finger of an operator but so that they nevertheless permit access to the button 20 with an instrument of smaller dimension than a finger. More specifically, the widths of the slots 42 and 43 are preferably less than approximately $\frac{1}{4}''$ in order to prevent the insertion of a finger through either of the slots 42 and 43. Also formed in the second housing section 32 in the central portion of the wall thereof which is opposite from the hinge line 34 is a circular aperture 44 which is dimensioned for receiving the locking portion 28 therein, and a lug 45 is formed on the inner side of the central portion of the wall of the housing section 30 which is opposite from the hinge line 34. A release hole 46 is formed in the main wall of the housing section 30 adjacent the lug 45.

The locking portion 28 includes a locking element 47 and a key 48. The locking element 47 is preferably integrally molded of a plastic material having a suitable degree of resiliency, such as Delrin (duPont TM) acetyl resin or Nylon (duPont TM). The locking element 47 preferably comprises a cylindrical barrel portion 49 having a longitudinal slot 50 therein and a peripheral collar 52, and it preferably further comprises a latch arm 54, a spring arm 56, and a stop element 58 which extend outwardly from the barrel portion 49. In this regard, as illustrated most clearly in FIG. 4, the latch arm 54, the spring element 56, and the stop element 58 are oriented so that when the barrel portion 49 is assembled in the second housing section 32 and the housing sections 30 and 32 are moved to the closed position, the latch arm 54 extends towards the lug 45 and so that it is engageable therewith for securing the housing sections 30 and 32 in the closed position. Further, the locking portion 28 is constructed so that when the latch arm 54 is in engagement with the lug 45, the spring element 56 extends outwardly and engages the wall of the housing section 32, and the stop element 58 also engages the wall of the housing section 32. However, the spring element 56 is constructed so that it is resiliently bendable to the position illustrated in FIG. 5 to enable the latch element 54 to be moved outwardly away from the lug 45 so that the housing sections 30 and 32 can be moved to the open positions thereof. In order to enable the barrel section 49 to rotate in aligned relation in the aperture 44 in the second housing section 32, alignment blocks 60 are provided adjacent the latch element 54, the spring element 56, and the stop element 58, the alignment blocks 60 normally engaging the inner side of the housing section 32 adjacent the aperture 44 therein to rotatably secure the barrel portion 49 in the housing section 32. The collar 52 is preferably constructed so that it is of only slightly greatly dimension than the barrel portion 49 so that the locking element 47 can be assembled with the housing section 32 by snapping it into an assembled position in the aperture 44. Further, the collar 52 is preferably constructed so that the safety lock 10 is frangible by depressing the locking element 47 inwardly into the housing 26 to disengage the latch arm 54 from the lug 45 so that the housing sections 30 and 32 can be separated. This provides an added degree of safety in the safety lock of the instant invention since it allows the safety lock 10 to be easily opened in the event of an emergency.

Since the safety lock 10 is only intended to prevent small children from disconnecting the seat belt sections 14 and 16 while they are riding in a vehicle, the locking portion 28 can be embodied as a relatively simple latch mechanism for detachably retaining the housing sections 30 and 32 in a closed position. Accordingly, the slot 50 is normally formed as a relatively straight slot, and the key 48 is normally embodied as a relatively straight and flat element which is receivable in the slot 50 to turn the barrel portion 49 and to thereby release the latch element 54 from the lug 45, although it will be understood that other types of elements could also be utilized for rotating the barrel portion 49.

Accordingly, for use and operation of the safety lock 10, a seat belt buckle 12 having seat belt sections 14 and 16 attached thereto is assembled in the housing 26, and the housing sections 30 and 32 are moved to the closed position. In this connection, as the housing sections 30 and 32 are moved to the closed position, the latch arm 54 engages the lug 45 so that the latch arm 54 is deflected outwardly, and the spring element 56 is resiliently deformed to the position illustrated in FIG. 5. However, as soon as the housing sections 30 and 32 have been moved to the fully closed position, the latch arm 54 is returned to its normal position by the spring element 56 so that it engages the lug 45 to retain the housing sections 30 and 32 in the closed position. Thereafter, if it is desired to open the housing sections 30 and 32, the key 48 can be inserted in the slot 50 to rotate the barrel portion 49 so that the latch arm 54 is disengaged from the lug 45. Further, it is possible to insert a small probe into the release hole 46 to disengage the latch arm 54 from the lug 45. Alternatively, it is possible to depress the entire locking element 47 inwardly into the housing 26 so that the collar 52 passes through the wall of the housing section 32 and so that the latch arm 54 is thereby disengaged from the lug 45. However, this operation is only intended for emergency applications since the locking assembly 28 cannot normally be reassembled in the housing 26. It is also possible to disconnect the seat belt sections 14 and 16 while the housing sections 30 and 32 are in the closed position by inserting an instrument such as the key 48 through the appropriate slot 42 or 43 which is aligned with the button 20 on the seat belt buckle 12. In this regard, the slots 42 and 43 are dimensioned to prevent the passage of a finger therethrough so that the button 20 cannot be depressed by a small child but so that an instrument, such as the key 48, can easily be inserted therethrough to manipulate the button 20.

It is seen, therefore, that the instant invention represents a significant advancement in the area of safety equipment for vehicles. Specifically, the safety lock of the instant invention can be effectively utilized for preventing a small child from disconnecting his or her seat belt while riding in a vehicle, although the seat belt can easily be disconnected by an adult when desired. Hence the risk of injury to a small child in a motor vehicle accident can be substantially reduced. Accordingly, it is seen that the safety lock of the instant invention represents a significant advancement in the art which has substantial merit from a safety standpoint.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A safety lock for a seat belt buckle wherein the buckle is of the type utilized for detachably interconnecting first and second seat belt sections and includes a body portion and a release button on said body portion for disconnecting said seat belt sections, said safety lock comprising a housing having hingeably connected first and second housing sections which are hingeable between a closed position wherein they cooperate to define an open interior cavity dimensioned for receiving and containing said buckle therein and an open position wherein said buckle is removable from said housing, said housing sections further cooperating to define first and second openings at opposite extremities of said housing for passing said first and second seat belt sections, respectively, outwardly therethrough when said buckle is received in said housing, said openings being dimensioned to prevent the passage of said buckle therethrough, while nevertheless permitting at least one of said seat belt sections to be removed from said housing when the said seat belt sections are disconnected, and key operated locking means mounted in one of said housing sections, said locking means being operable for releasably retaining said housing sections in said closed position and also being inwardly depressible to disengage said locking means from at least one of said housing sections to enable said housing sections to be hinged to said open position.

2. In the safety lock of claim 1, said housing having a reduced aperture therein which is substantially aligned with said release button when said buckle is received in said housing, said aperture being dimensioned to prevent access to said release button with a finger of an operator but to permit access to said release button with an instrument of smaller dimension than said finger.

3. In the safety lock of claim 2, said aperture further characterized as a first aperture, said housing having a second aperture therein, one of said apertures being disposed in each of said housing sections, said apertures being oriented so that when said buckle is in a normal first position in said housing, said first aperture is aligned with said release button, and so that when said buckle is in an inverted second position in said housing, said second aperture is aligned with said release button.

4. In the safety lock of claim 2, said aperture having a width of less than approximately one quarter of an inch.

5. In the safety lock of claim 2, said locking means comprising a locking element and a key for operating said locking element betwen locked and unlocked positions thereof, said key being removable from said locking element and being receivable in said aperture for operating said release button.

6. The safety lock of claim 5 further characterized as being frangible by depressing said locking element inwardly into said housing to release said housing sections to said open position.

7. In the safety lock of claim 6, said locking element having a peripheral collar thereon and being received in a mounting hole in said one of said housing sections in which it is mounted, said collar normally preventing said locking element from moving inwardly into said housing.

8. In combination, a seat belt comprising first and second seat belt sections and a buckle for detachably interconnecting said first and second seat belt sections, said buckle including a body portion and a release button on said body portion for disconnecting said seat belt sections, and a safety lock comprising a housing having hingeably connected first and second housing sections which are hingeable between a closed position wherein they cooperate to define an open interior cavity dimensioned for receiving and containing said buckle therein and an open position wherein said buckle is removable from said housing, said housing sections further cooperating to define first and second openings at opposite extremities of said housing for passing said first and second seat belt sections, respectively, outwardly therethrough when said buckle is received in said housing, said openings being dimensioned to prevent the passage of said buckle therethrough, while nevertheless permitting at least one of said seat belt sections to be removed from said housing when the said seat belt sections are disconnected, and key operated locking means mounted in one of said housing sections, said locking means being operable for releasably retaining said housing sections in said closed position and also being inwardly depressible to disengage said locking means from at least one of said housing sections to enable said housing sections to be hinged to said open position.

* * * * *